US011565275B2

(12) United States Patent
Xu et al.

(10) Patent No.: US 11,565,275 B2
(45) Date of Patent: Jan. 31, 2023

(54) WATER OUTLET DEVICE

(71) Applicant: RUNNER(XIAMEN) CORP., Xiamen (CN)

(72) Inventors: Shaojun Xu, Fujian (CN); Xinzhan Hu, Fujian (CN); Yisheng Zhang, Fujian (CN)

(73) Assignee: RUNNER(XIAMEN) CORP., Xiamen (CN)

( * ) Notice: Subject to any disclaimer, the term of this patent is extended or adjusted under 35 U.S.C. 154(b) by 128 days.

(21) Appl. No.: 17/086,449

(22) Filed: Nov. 1, 2020

(65) Prior Publication Data

US 2021/0129161 A1 May 6, 2021

(30) Foreign Application Priority Data

Nov. 5, 2019 (CN) ..... 201911071467.4

(51) Int. Cl.
*B05B 1/18* (2006.01)
*B05B 1/16* (2006.01)

(52) U.S. Cl.
CPC ..... *B05B 1/18* (2013.01); *B05B 1/1618* (2013.01)

(58) Field of Classification Search
CPC ..... B05B 1/18; B05B 1/1618; B05B 1/1636; B05B 1/16
See application file for complete search history.

(56) References Cited

U.S. PATENT DOCUMENTS 10,799,889 B2 * 10/2020 Lin ..... E03C 1/0409
2014/0110502 A1 * 4/2014 Yu ..... B05B 3/0427 239/240
2016/0325291 A1 * 11/2016 Zhou ..... B05B 1/18
2017/0320072 A1 * 11/2017 Zheng ..... B05B 1/1636
2019/0039079 A1 * 2/2019 Lin ..... B05B 12/04

* cited by examiner

*Primary Examiner* — Qingzhang Zhou
(74) *Attorney, Agent, or Firm* — Bayramoglu Law Offices LLC

(57) ABSTRACT

The present invention discloses a water outlet device, which comprises a water outlet body, wherein a water passing device consisting of a connecting seat, an impeller water distribution disc and a main body is arranged in the water outlet body, the impeller water distribution disc is arranged between the connecting seat and the main body, a primary water-passing hole is arranged on the impeller water distribution disc, at least two secondary water-passing holes connected with different water paths are arranged on the main body, a lower stop block in an annular array is arranged on the main body, an upper stop block in an annular array is arranged in the connecting seat, a water inlet capable of driving the impeller water distribution disc is also arranged on the main body, the impeller water distribution disc is also matched and connected with a switching device, the switching device can control the impeller water distribution disc to move upwards or downwards. Through the design of the above structure, the water outlet device can realize the switching of the water path function through the power of water pressure, the realization mode of the traditional switching control is changed, a novel switching structure is provided, the switching force value is reduced, and the comfort degree of the user is improved.

4 Claims, 7 Drawing Sheets

WATER OUTLET DEVICE

CROSS-REFERENCE TO RELATED APPLICATIONS

This application claims priority to China Patent application No. 201911071467.4 filed 2020 Nov. 5, all of which are hereby incorporated herein in their entireties by reference.

FIELD AND BACKGROUND OF THE INVENTION

1. Technical Field

The present invention relates to a water outlet device.

2. Description of Related Art

In the switching control of the water outlet device in the prior art, the waterway function is generally switched through a rotating surface cover, or the water outlet device is switched through a key structure, while the traditional key is generally switched by adopting a ball pen type structure or a ratchet type or a seesaw type pure mechanical structure, and the requirement value of the pure mechanical structure in the switching process is larger.

SUMMARY OF THE INVENTION

In order to solve the above technical problems, an object of the present invention is to provide a water outlet device, which combines a mechanical structure and a hydraulic power to perform switching through structural improvement, so as to reduce a required force value for switching control and improve user comfort.

The present invention is realized by the following technical scheme:

A water outlet device, comprising a water outlet body, wherein a water passing device consisting of a connecting seat, an impeller water distribution disc and a main body is arranged in the water outlet body, the impeller water distribution disc is arranged between the connecting seat and the main body, a primary water-passing hole is arranged on the impeller water distribution disc, at least two secondary water-passing holes connected with different water paths are arranged on the main body, a lower stop block in an annular array is arranged on the main body, an upper stop block in an annular array is arranged in the connecting seat, a water inlet capable of driving the impeller water distribution disc is also arranged on the main body, the impeller water distribution disc is also matched and connected with a switching device, the switching device can control the impeller water distribution disc to move upwards or downwards.

In the embodiment of the present invention, the switching device comprises a stroke base, the stroke base is matched and connected with a switching shaft, the switching shaft is matched and connected with the impeller water distribution disc, and a first spring is further arranged between the switching shaft and the connecting seat.

In the embodiment of the present invention, a second spring is also arranged between the stroke base and the connecting seat.

In the embodiment of the present invention, a third spring is arranged on the stroke base.

In the embodiment of the present invention, the stroke base is also matched and connected with a button rotor, and the button rotor is matched and connected with a key.

In the embodiment of the present invention, the water outlet body includes a shell and a surface cover, the surface cover is provided with the water-passing cavity of crossing that realizes different function water routes, and a water distribution disc is further provided between the surface cover and the main body, the water distribution disc is provided with a ultimate water-passing hole that can be matched with the secondary water-passing hole and communicate with the water-passing cavity of the water paths with different functions on the surface cover.

In the embodiment of the present invention, an impeller is further arranged between the water distribution disc and the surface cover.

In the embodiment of the present invention, and a water distribution body is also arranged between the connecting seat and the impeller water distribution disc.

In the embodiment of the present invention, and a sealing gasket is arranged between the impeller water distribution disc and the main body.

In the embodiment of the present invention, the first spring is arranged in the 2-axis direction, the second spring is arranged in the Y-axis direction, and the third spring is arranged in the X-axis direction.

The water outlet device provided by the invention has the following beneficial effects:

The combination of mechanical and hydraulic power is used to realize the rotation of the impeller water distribution disk, thereby changing the coordination between the secondary water-passing holes on the impeller water distribution disk and the water-passage cavities of the water paths with different functions, so as to realize the water outlet methods of different functions. Overcome the traditional design of the switching structure, provide a novel switching method, and at the same time have the effect of reducing the switching force value, and improve user comfort.

BRIEF DESCRIPTION OF THE DRAWINGS

In order to more clearly illustrate the technical solution of the present invention, the drawings used in the embodiments or the prior art descriptions will be briefly introduced below, and it is obvious that the drawings in the following description are only some embodiments of the present invention, and it is obvious for those skilled in the art to obtain other drawings based on the drawings without creative efforts.

Figure 1:
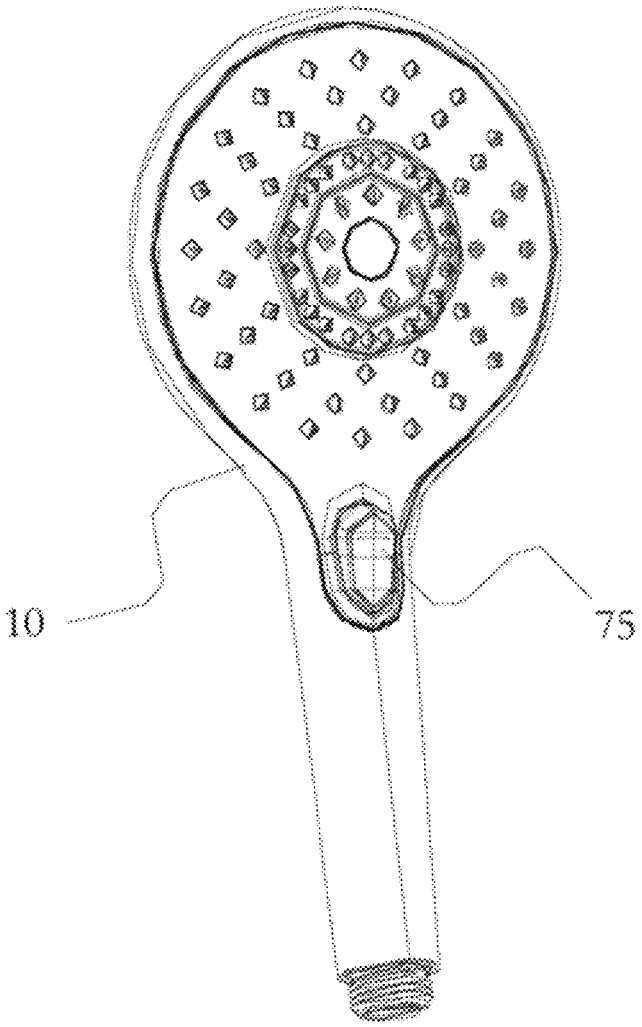
FIG. 1 is a stereogram view of the present invention.
Figure 2:
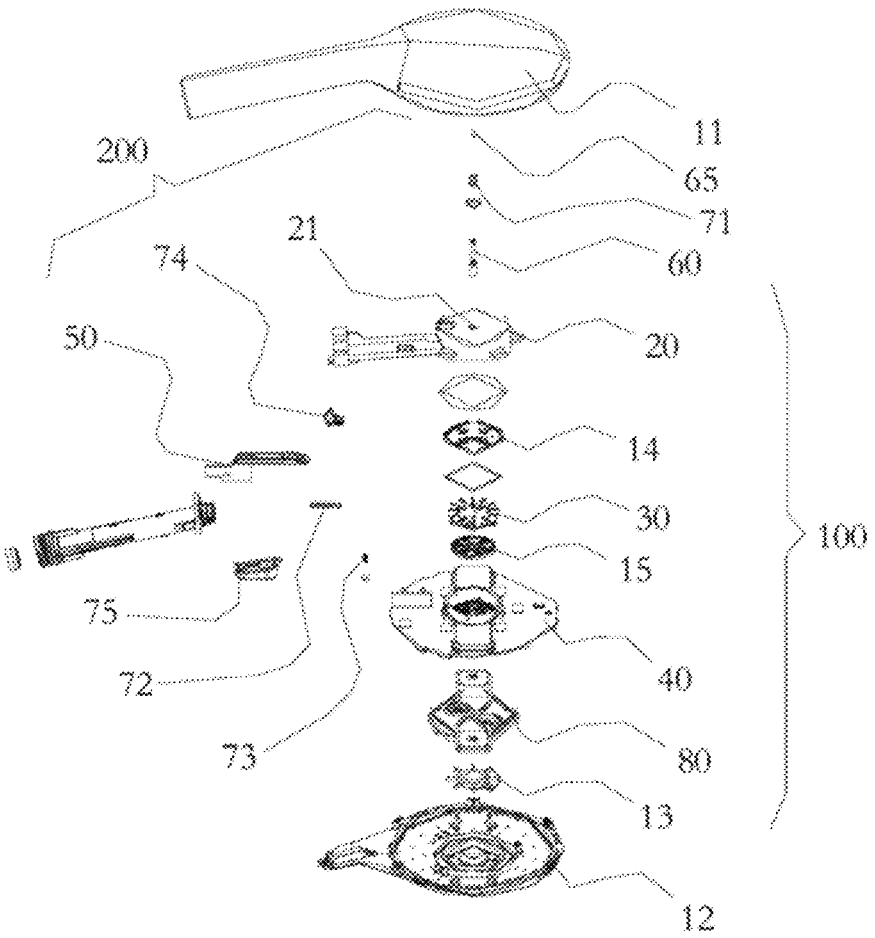
FIG. 2 is an exploded view of the present invention.
Figure 3:
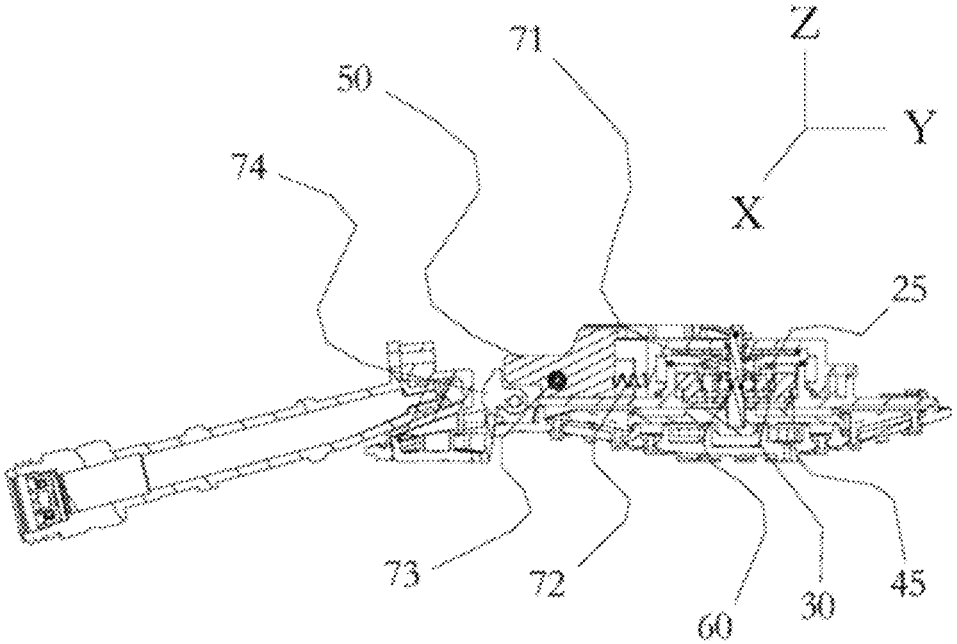
FIG. 3 is a cross-sectional view of the present invention.
Figure 4:
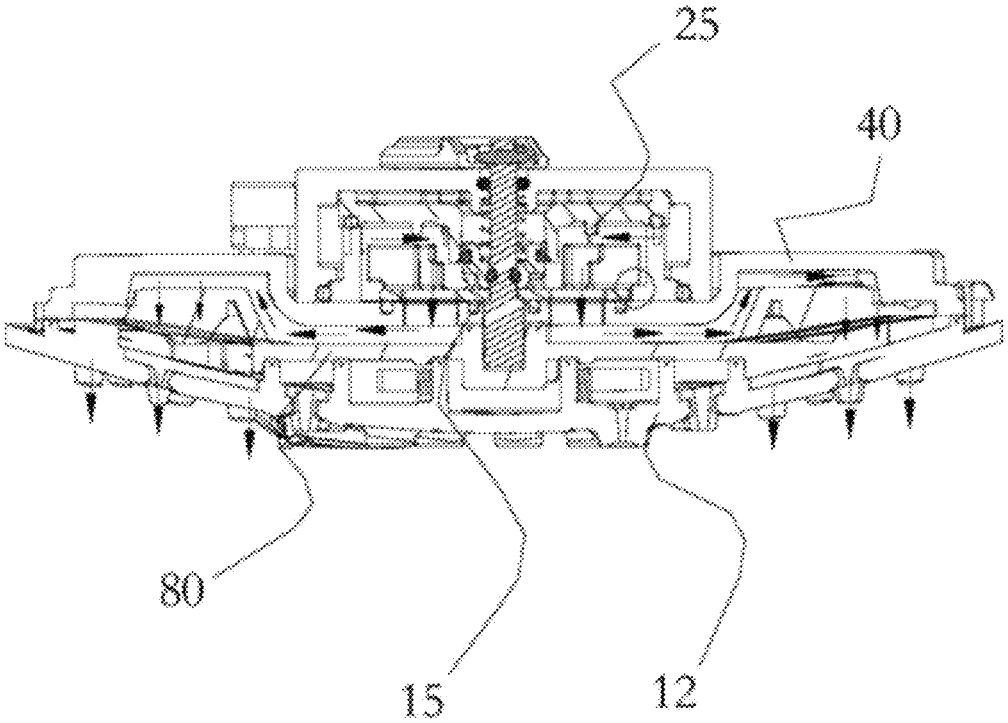
FIG. 4 is a schematic view 1 of the present invention.
Figure 5:
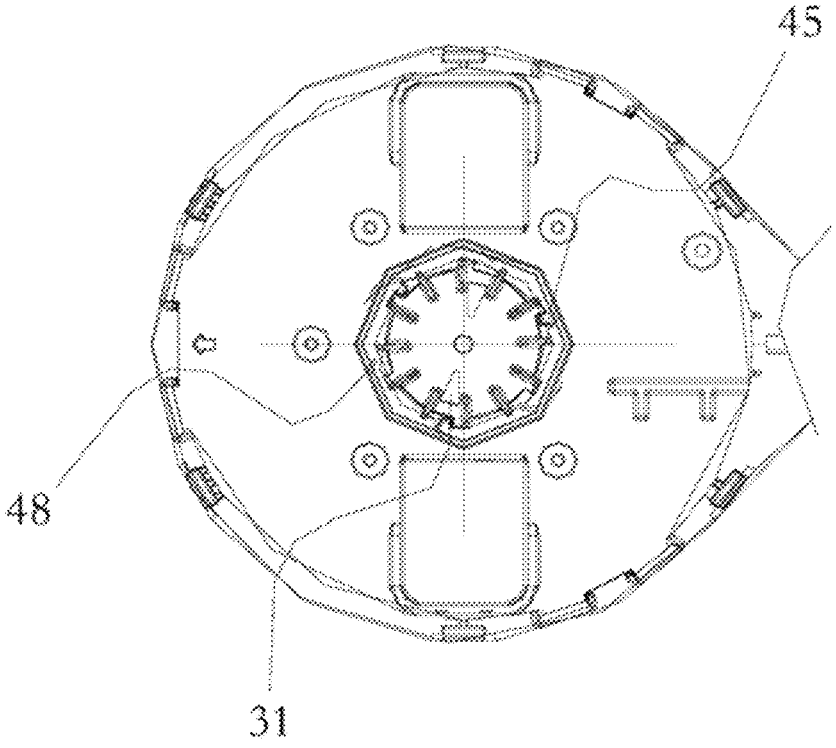
FIG. 5 is a schematic view 2 of the present invention.
Figure 6:
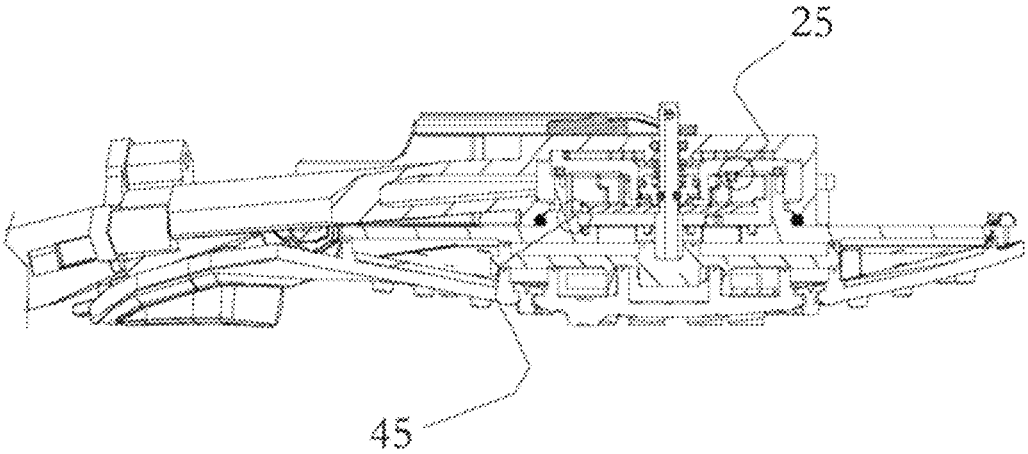
FIG. 6 is a schematic view 3 of the present invention.
Figure 7:
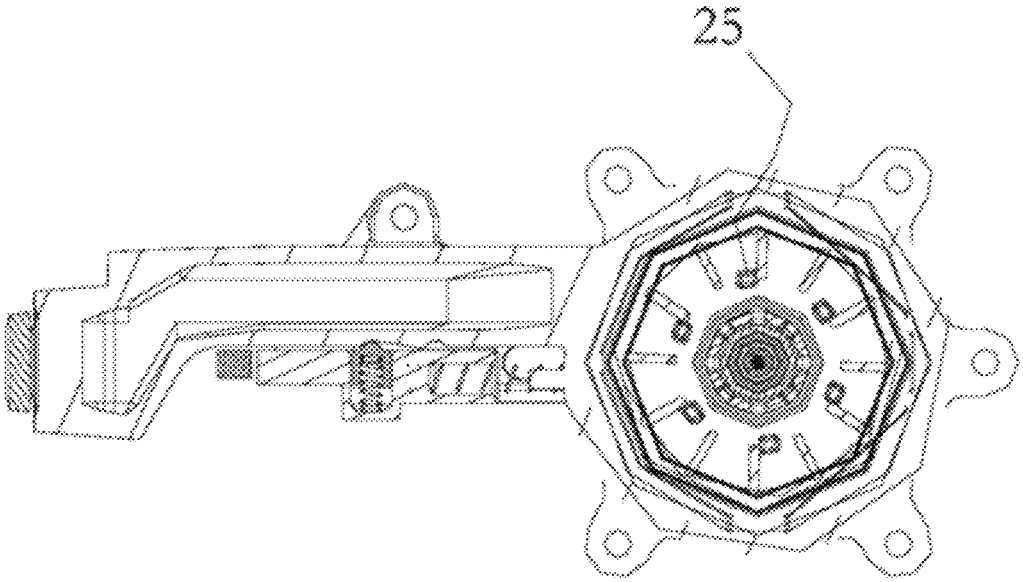
FIG. 7 is a schematic view 4 of the present invention.
Figure 8:
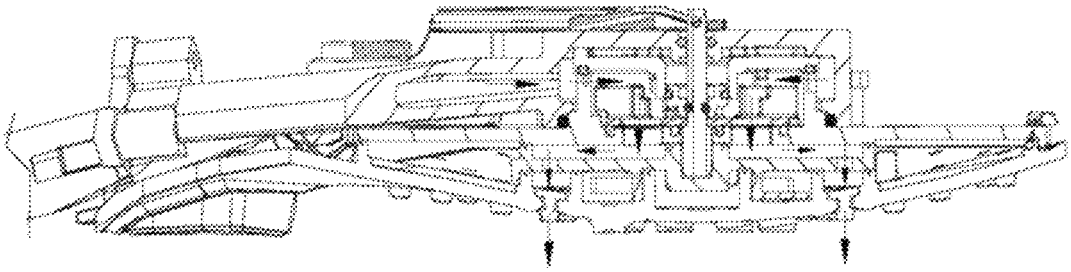
FIG. 8 is a schematic view 5 of the present invention.
Figure 9:
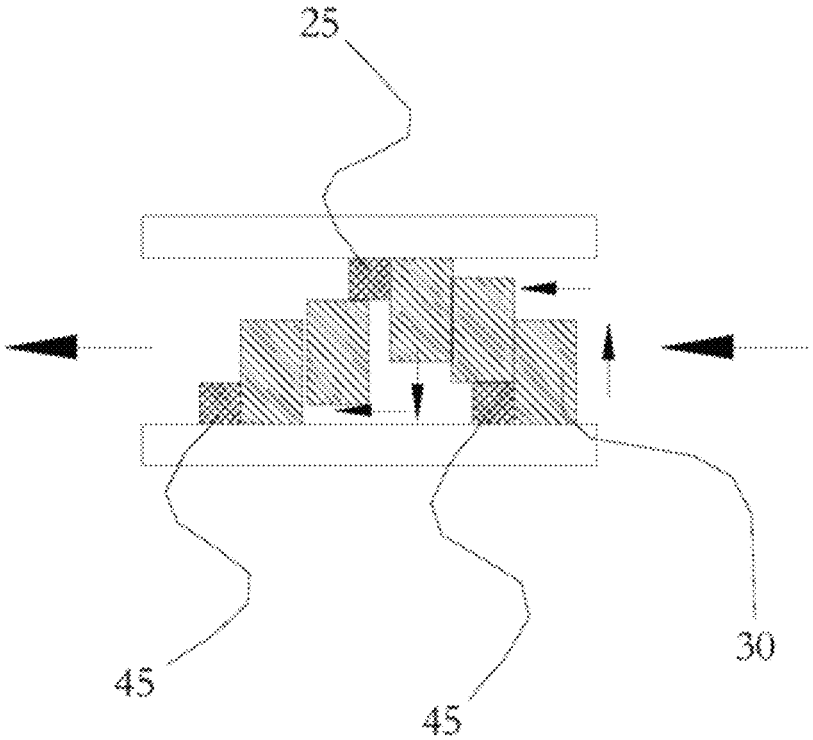
FIG. 9 is a schematic view of the movement of the impeller of the present invention.
Figure 10:
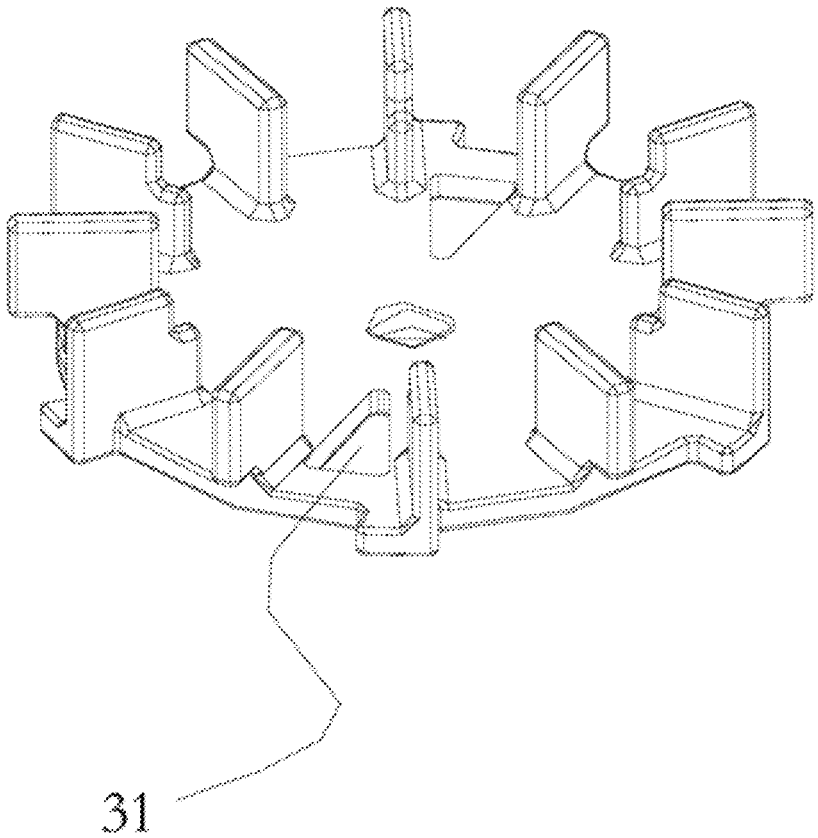
FIG. 10 is an enlarged schematic view of the impeller water distribution disc of the present invention.
Figure 11:
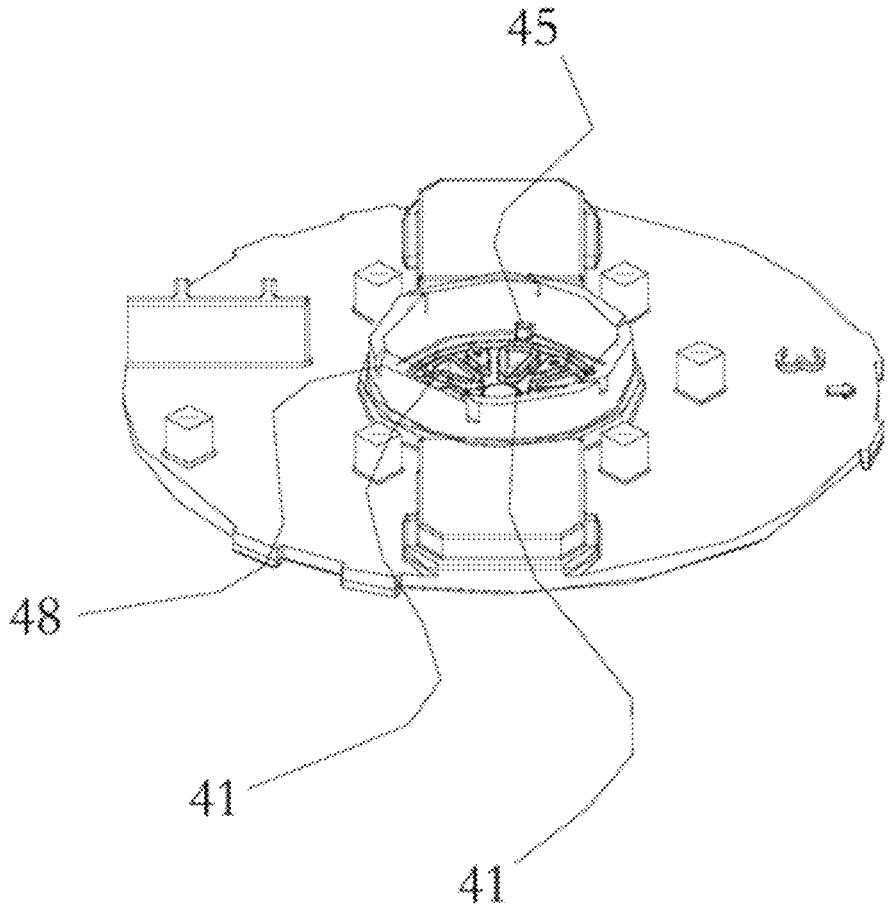
FIG. 11 is an enlarged schematic view of the main body of the present invention.
Figure 12:
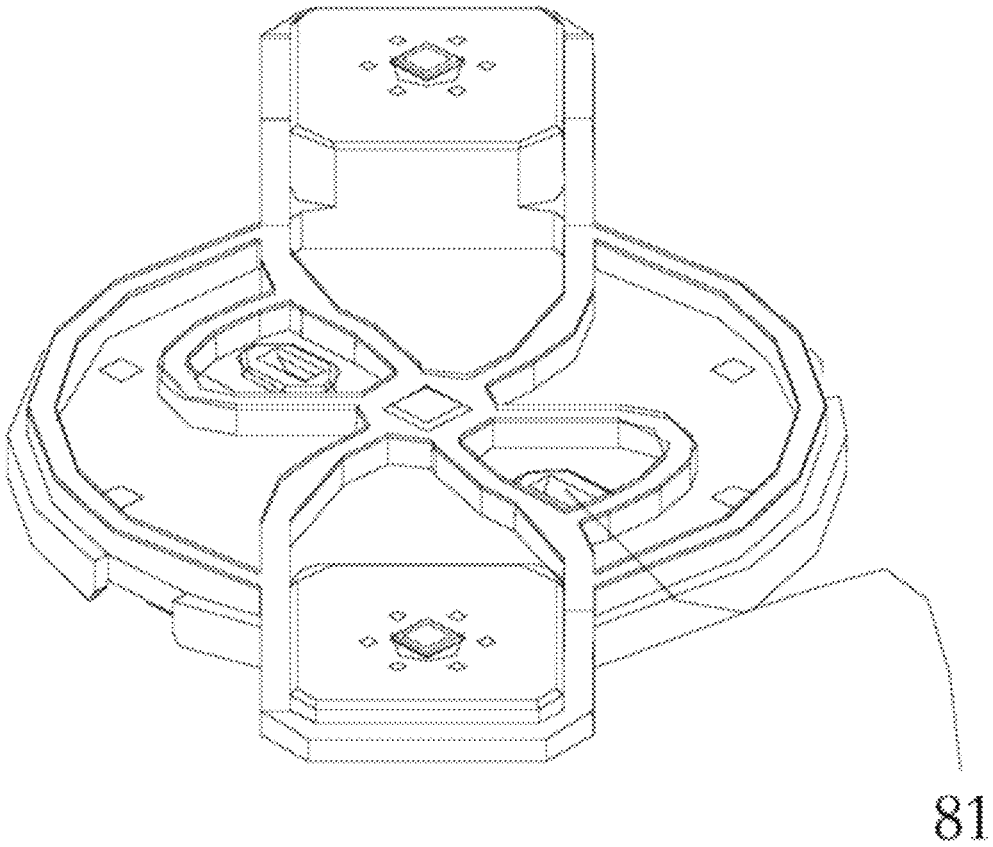
FIG. 12 is an enlarged schematic view of the water distribution disc of the present invention.
Figure 13:
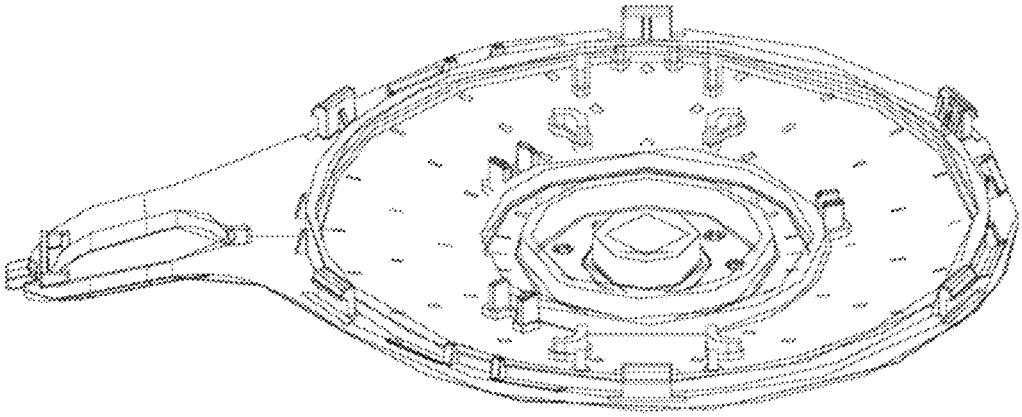
FIG. 13 is an enlarged schematic view of the face cover of the present invention.

In the figure: 10—water outlet body; 11—shell; 12—surface cover; 13—impeller; 14—water distribution body; 15—sealing gasket; 20—connection seat; 21—slide way; 25—upper stop block; 30—impeller water distribution disc; 31—primary water-passing hole; 40—body, 41—secondary water-passing hole; 45—lower stop block; 48—water inlet; 50—stroke base; 60—switching shaft; 65—bolt; 71—first spring; 72—second spring; 73—third spring; 74—button rotor; 75—key; 80—water distribution disc; 81—ultimate water-passing hole; 100—water passing device; 200—switching device.

DESCRIPTION OF THE PREFERRED EMBODIMENTS

The technical solutions in the embodiments of the present invention will be clearly and completely described below with reference to the drawings in the embodiments of the present invention, and it is obvious that the described embodiments are only a part of the embodiments of the present invention, and not all of the embodiments. All other embodiments, which can be obtained by a person skilled in the art without making any creative effort based on the embodiments of the present invention, belong to the protection scope of the present invention.

Referring to the attached drawings of the specification, wherein a water passing device 100 consisting of a connecting seat 20, an impeller water distribution disc 30 and a main body 40 is arranged in the water outlet body 10, the impeller water distribution disc 30 is arranged between the connecting seat 20 and the main body 40, a primary water-passing hole 31 is arranged on the impeller water distribution disc 30, at least two secondary water-passing holes 41 connected with different water paths are arranged on the main body 40, a lower stop block 45 in an annular array is arranged on the main body 40, an upper stop block 25 in an annular array is arranged in the connecting seat 20, a water inlet 48 capable of driving the impeller water distribution disc 30 is also arranged on the main body 40, specifically, the water inlet 48 can generate oblique water flow, so as to drive the impeller water distribution disc 30 to rotate, the impeller water distribution disc 30 is also matched and connected with a switching device 200, the switching device 200 can control the impeller water distribution disc 30 to move upwards or downwards. More specifically, the switching device 200 comprises a stroke base 50, the stroke base 50 is matched and connected with a switching shaft 60, the switch shaft 60 and the stroke base 50 are connected and fixed by a bolt 65, the bolt 65 is in a vertical fixed relationship with the switch shaft 60, and the switching shaft 60 is matched and connected with the impeller water distribution disc 30, and a first spring 71 is further arranged between the switching shaft 60 and the connecting seat 20.

Further, a second spring 72 is also arranged between the stroke base 50 and the connecting seat 20, a third spring 73 is arranged on the stroke base 50, the stroke base 50 is also matched and connected with a button rotor 74, and the button rotor 74 is matched and connected with a key 75.

The present invention adopts the design of the above structure, a user presses the key 75 to drive the button rotor 74 to rotate, so that the stroke base 50 moves, and due to the vertical fixed relation between the switching shaft 60 and the bolt 65, the fixed arrangement of the slide way 21 between the switching shaft 60 and the connecting seat 20 and the effect of the stroke height difference on the stroke base 50, the switching shaft 60 will move upward along the slide way 21 on the connecting seat 20, so that the impeller water distribution disc 30 is lifted. In an initial state, that is, in a state that a user does not press the key 75, the impeller water distribution disc 30 is located at the lower end of the main body 40 and is matched with the lower stop block 45 to act, when the user presses the key 75, the impeller water distribution disc 30 will lift upward to be separated from the action range of the lower stopper 45 and enters the action range of the upper stop block 25, under the action of driving water flow generated by the water inlet 48, the impeller water distribution disc 30 rotates until being in contact with the upper stop block 25 and limited to move, and at the moment, the first spring 71 and the second spring 72 are in a compressed state. When a user releases the key 75, the first spring 71 and the second spring 72 are reset, the impeller water distribution disc 30 leaves the limited position under the action of the first spring 71 and the second spring 72 and continues to enter the limited area of the lower stop block 45, and under the action of water flow driven by the water inlet 48, the impeller water distribution disc 30 continues to rotate for a certain angle until the impeller water distribution disc 30 contacts the lower stop block 45, and at the moment, a water path switching action is completed, and another water outlet effect is formed.

Further, In the embodiment of the present invention, the water outlet body 10 can form two water outlet effects with different functions, in this embodiment, the main body 40 is provided with two secondary water-passing holes 41 with different flow directions, and the secondary water-passing holes 41 are distributed in a circulating manner. Of course, the present invention is not limited to two water outlet effects with different functions, but three, four or more, and only needs to change the number of the types of the secondary water-passing holes 41 and to circularly arrange the secondary water-passing holes in sequence.

Further, the first spring 71 is arranged in the Z-axis direction, the second spring 72 is arranged in the Y-axis direction, and the third spring 73 is arranged in the X-axis direction.

Furthermore, the water outlet body 10 includes a shell 11 and a surface cover 12, the surface cover 12 is provided with the water-passing cavity of crossing that realizes different function water routes, and a water distribution disc 80 is further provided between the surface cover 12 and the main body 40, the water distribution disc 80 is provided with a ultimate water-passing hole 81 that can be matched with the secondary water-passing hole 41 and communicate with the water-passing cavity of the water paths with different functions on the surface cover 12.

Further, in the embodiment of the present invention, an impeller 13 is further arranged between the water distribution disc 80 and the surface cover 12, and a water distribution body 14 is also arranged between the connecting seat 20 and the impeller water distribution disc 30, and a sealing gasket 15 is arranged between the impeller water distribution disc 30 and the main body 40.

In the using process, the upward movement of the impeller water distribution disc 30 is realized by controlling the key 75, and the rotation of the impeller water distribution disc 30 is realized under the impact of water pressure, so that the matching position relation of the primary water-passing hole 31 and the secondary water-passing hole 41 is changed, and the switching of water ways with different functions is realized.

While the foregoing specification illustrates and describes the preferred embodiments of the present invention, it is to be understood that the invention is not limited to the forms disclosed herein, but is not to be construed as limited to the disclosed embodiments, and that modifications and environments may be utilized and adapted to various other combinations, modifications, and environments, and may be made within the scope of the inventive concept as described herein, either by the above teachings or by the skill or knowledge of the relevant art. And that modifications and variations may be effected by those skilled in the art without departing from the spirit and scope of the invention as defined by the appended claims.

What is claimed is:

1. A water outlet device, comprising:

a water outlet body;

a water passing device comprising a connecting seat, an impeller water distribution disc, and a main body, wherein the water passing device is arranged in the water outlet body, and the impeller water distribution disc is arranged between the connecting seat and the main body;

a primary water-passing hole arranged on the impeller water distribution disc;

at least two secondary water-passing holes arranged on the main body, wherein the at least two secondary water-passing holes are connected with different water paths;

a lower stop block in an annular array arranged on the main body;

an upper stop block in an annular array arranged in the connecting seat;

a water inlet arranged on the main body capable of driving the impeller water distribution disc; and a switching device matched and connected with the impeller water distribution disc, wherein the switching device is configured to control the impeller water distribution disc to move upwards or downwards, and the switching device comprises a stroke base, the stroke base is matched and connected with a switching shaft, the switching shaft is matched and connected with the impeller water distribution disc, and a first spring is further arranged between the switching shaft and the connecting seat;

a second spring is further arranged between the stroke base and the connecting seat;

a third spring is arranged on the stroke base;

the stroke base is further matched and connected with a button rotor, and the button rotor is matched and connected with a key;

the water outlet body includes a shell and a surface cover, the surface cover is provided with a water-passing cavity, and a water distribution disc is further provided between the surface cover and the main body, the water distribution disc is provided with an ultimate water-passing hole configured to be matched with the secondary water-passing hole and communicate with the water-passing cavity on the surface cover; and the first spring is arranged in a Z-axis direction, the second spring is arranged in a Y-axis direction, and the third spring is arranged in an X-axis direction.

2. The water outlet device according to claim 1, wherein an impeller is further arranged between the water distribution disc and the surface cover.

3. The water outlet device according to claim 1, wherein a water distribution body is further arranged between the connecting seat and the water distribution disc.

4. The water outlet device according to claim 1, wherein a sealing gasket is arranged between the water distribution disc and the main body.

* * * * *